US009085966B2

(12) United States Patent
Rahman et al.

(10) Patent No.: US 9,085,966 B2
(45) Date of Patent: Jul. 21, 2015

(54) METHOD FOR TRANSIENT TESTING OF OIL WELLS COMPLETED WITH INFLOW CONTROL DEVICES

(71) Applicant: Saudi Arabian Oil Company, Dhahran (SA)

(72) Inventors: Noor M. Anisur Rahman, Dhahran (SA); Faisal M. Al-Thawad, Dammam (SA); Saud A. BinAkresh, Dhahran (SA)

(73) Assignee: SAUDI ARABIAN OIL COMPANY (SA)

( * ) Notice: Subject to any disclaimer, the term of this patent is extended or adjusted under 35 U.S.C. 154(b) by 380 days.

(21) Appl. No.: 13/776,931

(22) Filed: Feb. 26, 2013

(65) Prior Publication Data

US 2013/0220008 A1 Aug. 29, 2013

Related U.S. Application Data

(60) Provisional application No. 61/603,723, filed on Feb. 27, 2012.

(51) Int. Cl.

| | |
|---|---|
| ***E21B 47/10*** | (2012.01) |
| *E21B 43/12* | (2006.01) |
| *E21B 43/14* | (2006.01) |

(52) U.S. Cl.

CPC ..... *E21B 47/10* (2013.01); *E21B 43/12* (2013.01); *E21B 43/14* (2013.01)

(58) Field of Classification Search

CPC ..... E21B 43/12; E21B 43/14; E21B 47/10

See application file for complete search history.

(56) References Cited

U.S. PATENT DOCUMENTS

| | | | | |
|---|---|---|---|---|
| 5,934,371 | A * | 8/1999 | Bussear et al. | 166/53 |
| 8,116,980 | B2 | 2/2012 | Beretta et al. | |
| 2009/0276156 | A1 * | 11/2009 | Kragas et al. | 702/6 |

(Continued)

FOREIGN PATENT DOCUMENTS

WO 2011025471 A1 3/2011

OTHER PUBLICATIONS

Furui, "A comprehensive skin factor model for well completions based on finite element simulations," Univ. of Texas at Austin, May 2004.*

(Continued)

*Primary Examiner* — John Fitzgerald

(74) *Attorney, Agent, or Firm* — Bracewell & Giuliani LLP; Constance Gall Rhebergen; Brad Y. Chin

(57) ABSTRACT

Disclosed is a method for transient testing of an oil well to determine the individual, distinct skin factor components of an apparent skin factor, which includes opening the well to a first predefined choke setting to allow the reservoir fluid to flow through the well for a first predefined period of time, and measuring a production rate of the reservoir fluid through the well, when the first predefined period of time expires. The method further includes performing a shut-in of the well for a first predefined build-up period, and repeating, when the first predefined build-up period expires, the steps of the flowing, the measuring, and the performing for at least two additional choke settings. The distinct skin factor components of the apparent skin factor are determined using a graphical relationship between the determined apparent skin factors and the measured production rates.

7 Claims, 4 Drawing Sheets

(56) References Cited

U.S. PATENT DOCUMENTS

| | | | | |
|---|---|---|---|---|
| 2010/0023269 | A1* | 1/2010 | Yusti et al. | 702/12 |
| 2010/0307743 | A1 | 12/2010 | Ziuddin | |
| 2011/0087471 | A1 | 4/2011 | Postl et al. | |

OTHER PUBLICATIONS

Everdingen, "The skin effect and its influence on the productive capacity of a well," Petroleum Transactions, vol. 198, 1953, pp. 171-176.*

PCT International Search Report and the Written Opinion of the International Searching Authority dated Feb. 17, 2014; International Application No. PCT/US2013/027949; International File Date: Feb. 27, 2013.

Birchenko, V. M., et al., Analytical Modelling of Wells with Inflow Control Devices; Jul. 1, 2010; pp. 1-134; http://www.ros.hw.ac.uk/bitstream/10399/2349/1/BirchenkoV_0710_pe.pdf.

Morris, C. W., et al., Analysis of Geothermal Wells in Naturally Fractured Formations With Rate-Senstive Flow; SPE Formation Evaluation; Dec. 1, 1987; pp. 567-572; Society of Petroleum Engineers; http://www.onepetro.org/google/Papers/SPE/eJournal_Papers/spe/1987/FE/12/00014169/00014169.pdf?id=00014169&soc=SPE.

Su, H-J., et al., Modeling of Equalizer Production Sytem and Smart-Well Applications in Full-Field Studies; SPE Reservoir Evaluation & Engineering; Apr. 1, 2009; pp. 318-328; Society of Petroleum Engineers; http://www.onepetro.org/google/Papers/SPE/eJournal_Papers/spe/2009/EREE/SPE-111288-PA/SPE-111288-PA-P.pdf?id=SPE-111288-PA&soc=SPE.

2 Inflow Performance, Produced Water Reinjection Joint Industry Program; Jan. 1, 2003; pp. 1-38; http://www.advntk.com/pwrijip2003/pwri/toolbox/monitoring/well_performance/well_performance.htm.

Schlumberger, Well Test Interpretation; Jan. 1, 2002; pp. 1-122; http://www.fanarco.net/books/reservoir/Well_Test_Interpretation_Schlumberger.pdf.

Zhuoyi, Li, et al., "Understanding the Roles of Inflow-Control Devices in Optimizing Horizontal-Well Performance," OnePetro, vol. 26, No. 3, Sep. 2011, pp. 376-385.

* cited by examiner

METHOD FOR TRANSIENT TESTING OF OIL WELLS COMPLETED WITH INFLOW CONTROL DEVICES

RELATED APPLICATION

This application is related to, and claims priority to, U.S. Provisional Patent Application Ser. No. 61/603,723, filed on Feb. 27, 2012, the disclosure of which is incorporated by reference in its entirety.

BACKGROUND

1. Field of the Invention

Embodiments of the invention generally relate to a method for transient testing of an oil well completed with an inflow control device (ICD), and more particularly, to a method for transient testing of an oil well completed with one or more ICDs, which determine reservoir and well parameters for deciding whether stimulation of the oil well would improve well productivity.

2. Description of the Related Art

Transient well testing provides an indirect determination of reservoir and well parameters for optimizing the productivity of an oil well. Transient testing is one of the most important tools in a spectrum of diagnostic tools used by petroleum engineers to characterize hydrocarbon assets and predict their future performance.

The long-term productivity of an oil well is influenced by many factors, including, for example, petrophysical or fluid properties of the oil, the degree of formation damage in the well and/or stimulation of the well, well geometry, well completion characteristics, the number of fluid phases in the wellbore, and the flow-velocity type of fluids through the wellbore.

When a well is drilled, it is preferred to have a positive differential pressure acting from the wellbore to the formation to prevent inflow of reservoir fluid. Consequently, some of the drilling fluid can penetrate the formation and particles suspended in the mud can partially penetrate pore spaces in the wellbore, reducing formation permeability and causing formation damage around the wellbore. Formation damage around the wellbore causes additional resistance to fluid flow through the wellbore, which can generate an additional pressure drop or loss of fluid flow into and through the wellbore, minimizing well productivity.

On the other hand, stimulation operations, for example, use of specifically designed fluids in a well can decrease the effect of the pressure drop in the near-wellbore region caused by the formation damage by improving the formation permeability around the wellbore. The impact of permeability impairment/improvement around the wellbore caused by drilling, production, and stimulation operations can be quantified in terms of a mechanical skin factor.

An ICD is a completion hardware device that has been deployed as a part of a well completion aimed at distributing the inflow of oil evenly through the well. Even though various designs have been used for the ICD, the principle for each ICD is the same—restrict fluid flow by creating an additional pressure drop that balances or equalizes the wellbore pressure drop caused by, for example, formation damage to achieve an evenly distributed flow profile along the length of the well. With a more evenly distributed flow profile, one can reduce, for example, water or gas coning, sand production, and address other drawdown-related production problems encountered in wells during production.

Conventional transient testing methods have been used to evaluate reservoir and oil parameters for determining whether a well completed with ICDs should be stimulated to improve the well's productivity. Conventional transient testing methods measure one or more production rates of the well to determine an apparent skin factor which is the summation of a well skin factor (i.e., representing a change in pressure [in the bore] caused by an altered region around the wellbore in comparison to an unaltered reservoir) and a completion skin factor (i.e., representing a pressure reading at a point in the production tubing downstream of the ICD or ICDs). Because these conventional transient testing methods are only able to determine the apparent skin factor as a summation of the well skin factor and the completion skin factor (i.e., does not distinguish between the individual well skin and completion skin factors), petroleum engineers are unable to specifically determine whether the well should be stimulated to improve the well's productivity.

Therefore, what is needed is a method for transient testing of an oil (or gas, as would be contemplated by one of ordinary skill in the relevant art) well completed with one or more ICDs, which determines the individual components of the mechanical skin factor (e.g., the respective well skin factor and the completion skin factor), so that an operator can determine from the well skin factor whether stimulation of the well would improve the well's productivity.

SUMMARY

Embodiments of the invention are directed to a method for transient testing of a well completed with one or more ICDs. In particular, various embodiments of the invention provide for a method for transient testing of an oil well completed with one or more ICDs, which determines, for example, reservoir permeability, well skin factor, and ICD characteristic parameters of the well under field conditions, enabling reservoir management and production engineering personnel to assess the effects of formation damage of a well with a higher probability of certainty, and to determine whether stimulation of the well would improve the well's productivity.

In particular, there is provided a method for transient testing of an oil well to determine the individual, distinct skin factor components of an apparent skin factor, which includes opening the well to a first predefined choke setting to allow the reservoir fluid to flow through the well for a first predefined period of time, and measuring a production rate of the reservoir fluid through the well, when the first predefined period of time expires. The method further includes performing a shut-in of the well for a first predefined build-up period, and repeating, when the first predefined build-up period expires, the steps of the flowing, the measuring, and the performing for at least two additional choke settings. Each of the additional choke settings is consecutively lower than a preceding choke setting. Further, the method includes determining an apparent skin factor for each measured production rate. The apparent skin factor is a function of the measured production rate. When each of the determined apparent skin factors is plotted against a respective squared-measured production rate value, the plotted values form a linear relationship. The method further includes determining a well skin factor and a completion skin factor based on the determined apparent skin factor. The well skin factor is defined by an intercept of the linear relationship, when the squared-measured production rate is zero and the completion skin factor is defined by a product of the slope of the linear relationship and the squared-measured production rate.

BRIEF DESCRIPTION OF DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

Although the following detailed description contains many specific details for purposes of illustration, it is understood that one of ordinary skill in the relevant art will appreciate that many examples, variations, and alterations to the following details are within the scope and spirit of the invention. Accordingly, the exemplary embodiments of the invention described herein are set forth without any loss of generality, and without imposing limitations, relating to the claimed invention. Like numbers refer to like elements throughout. Prime notation, if used, indicates similar elements in alternative embodiments.

As used herein, the term "inflow control device" or "ICD" shall be used to refer to a completion hardware device used in a well, which distributes the inflow of a material, for example, oil or gas, evenly through the well. The ICD can create an additional pressure drop that balances or equalizes the wellbore pressure drop caused by, for example, formation damage to achieve an evenly distributed flow profile along the length of the well. With a more evenly distributed flow profile, one can reduce, for example, water or gas coning, sand production, and address other drawdown-related production problems encountered in wells during production. The term "apparent skin factor" shall be used to refer to a parameter used to predict the performance of a well. For example, the apparent skin factor can refer to a parameter calculated from pressure testing the well, which defines the degree of formation damage in the well. The apparent skin factor represents, for example, a linear combination of the mechanical (well) skin factor and a completion skin factor.

The term "well skin factor" shall be used to refer to a parameter of the well, which defines a change (positive or negative) in pressure of a reservoir fluid flowing through a wellbore caused by an altered region (improvement or damage) around the wellbore in comparison to a virgin reservoir. The well skin factor is positive when the formation around the wellbore is damaged, negative when the formation around the wellbore is improved, and zero when formation around the wellbore is neither damaged or improved.

The term "completion skin factor" shall be used to refer to a parameter of the well, which defines a change in pressure of a reservoir fluid flowing through a wellbore caused by the operation of an ICD (i.e., distinct from the pressure drop caused by formation damage). The completion skin factor is usually positive.

Figure 1:
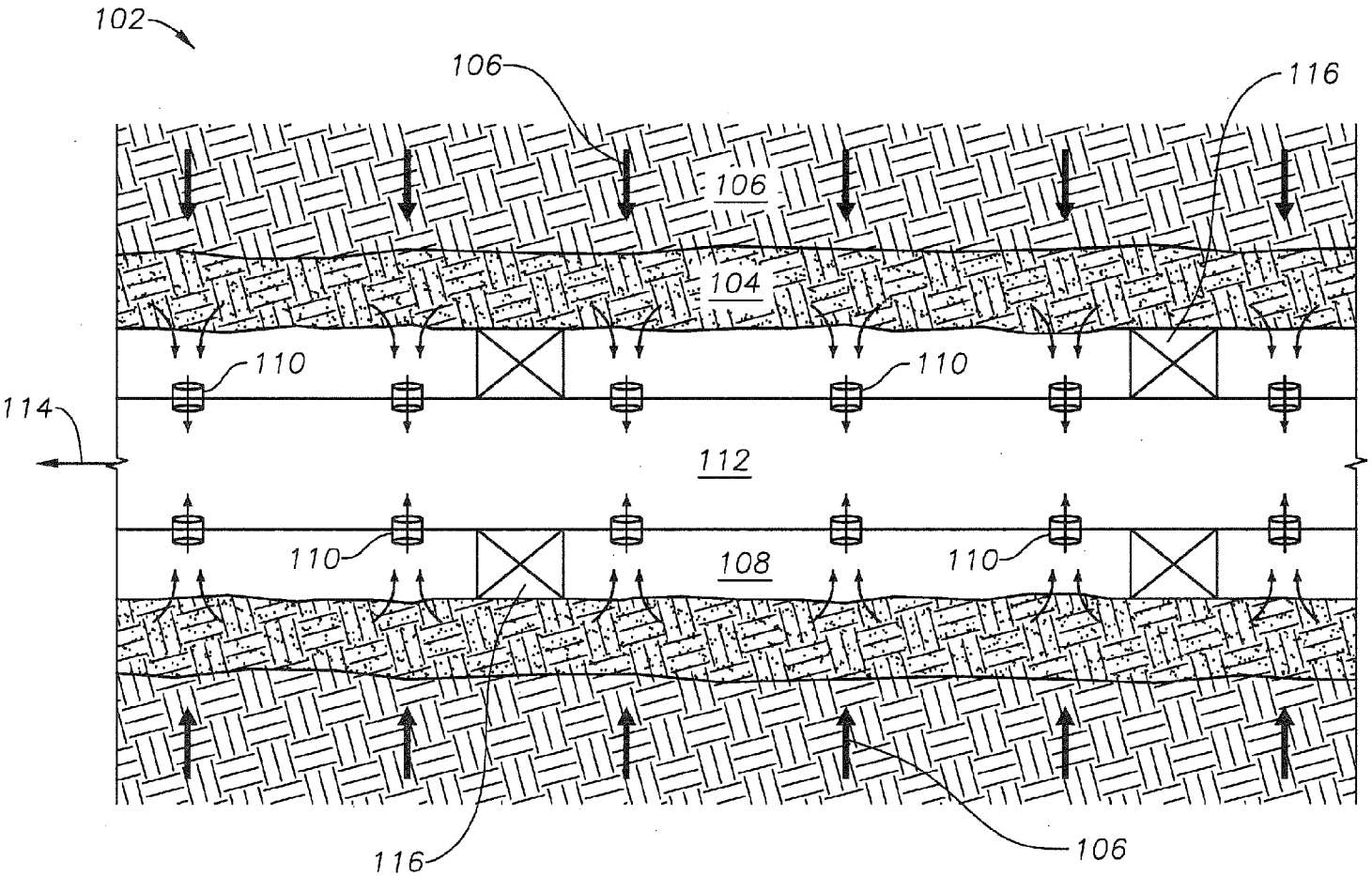
FIG. 1 shows a mechanism of reservoir fluid flow when a well is completed with one or more ICDs, in accordance with an embodiment of the invention.

FIG. 1 shows a mechanism of reservoir fluid flow through a well completed with one or more ICDs, in accordance with an embodiment of the invention. According to various embodiments of the invention, the reservoir fluid flowing through the wellbore 102 experiences a change (positive or negative) in pressure due to the altered region 104 (improvement or damage) around the wellbore 102 in comparison with a virgin reservoir. As previously noted above, this pressure change is characterized by the well skin factor. The reservoir fluid flows from the undamaged formation 106 through the altered region 104 of the wellbore, enters the annulus 108 of the wellbore 102, and passes through one or more ICDs 110 and tubing 112 of the wellbore on route to the production string 114 of the wellbore. The number of ICDs 110 are selected, for example, based on the additional pressure drop that is needed to balance or equalize the wellbore pressure drop for optimizing oil production. In accordance with at least one embodiment, one or more packers 116 are provided, for example, in the annulus 108 of the wellbore 102, to isolate sections of one or more ICDs in place.

Figure 2:
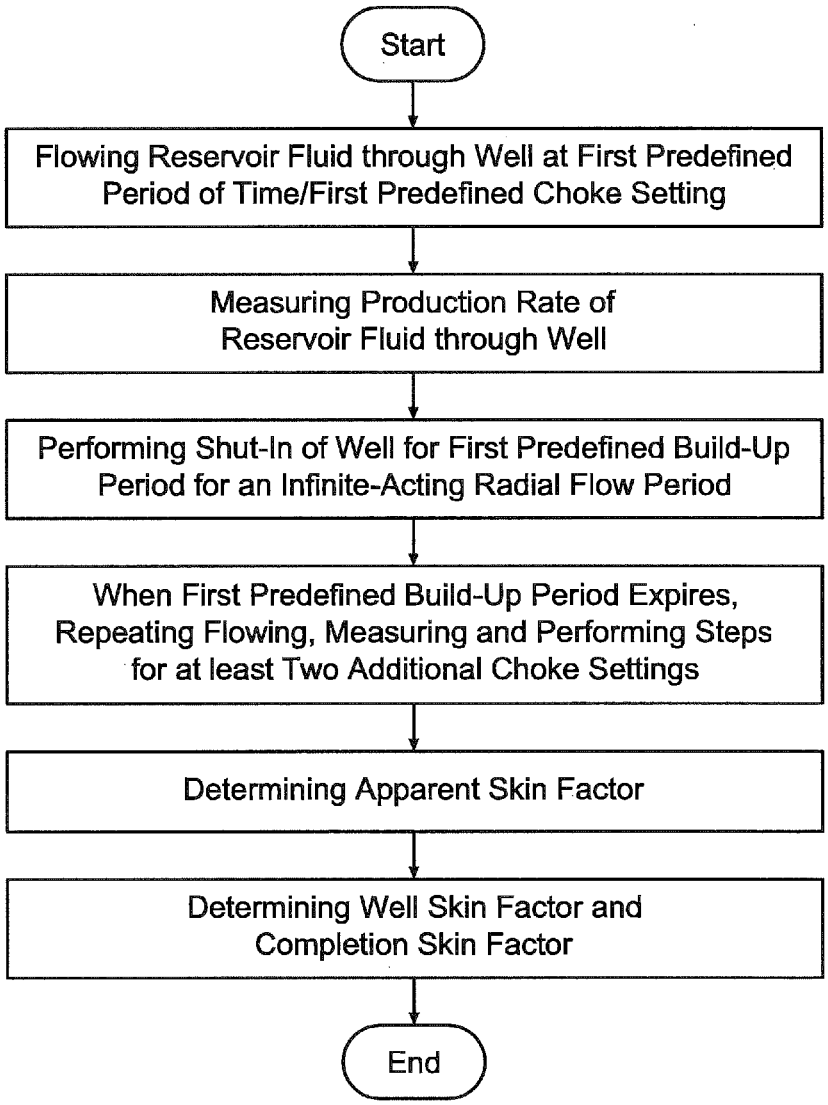
FIG. 2 shows a method for transient testing of a well completed with one or more ICDs, in accordance with an embodiment of the invention.

FIG. 2 shows a method for transient testing of a well completed with one or more ICDs, in accordance with an embodiment of the invention. According to an embodiment of the invention, the transient testing method includes a selection of at least three choke settings for which transient testing measurements are taken for different values of controlled production rates. In accordance with an embodiment of the invention, the difference between each production rate tested should be a specified distance apart from one another, for example, at least 500 stock tank barrels/day, which would generate a spread of data points for calculating the apparent skin factor for the well.

In accordance with at least one embodiment, one or more measurement gauges are inserted into the wellbore at a proximity close to the feed reservoir to, for example, minimize the amount of frictional pressure drop between a position at the end of the completion string and the measurement gauge(s), and to, for example, minimize wellbore storage effects.

According to an embodiment of the invention, the method includes opening the well to the highest selected choke setting to allow the reservoir fluid to flow for a specified period of time, for example, 72 hours, without allowing the pressure in the wellbore to fall below the bubble-point pressure in the reservoir at any time during the specified period. At the end of the specified period, the production rate is measured for each individual phase of the reservoir fluid. The well is shut-in for a first build-up period, which should be long enough to establish an infinite-acting radial flow regime.

Once the infinite-acting radial flow regime is established, the method further includes opening the well to the next highest selected choke setting to allow the reservoir fluid to flow for a specified period of time, for example, 24 hours, without allowing the pressure in the wellbore to fall below the bubble-point pressure in the reservoir at any time during the specified period. At the end of the specified period, the production rate is measured for each individual phase of the reservoir fluid. The well is shut-in for a second build-up period, which should be long enough to establish an infinite-acting radial flow regime.

The method further includes opening the well to the lowest selected choke setting to allow the reservoir fluid to flow for a specified period of time, for example, 24 hours, without allowing the pressure in the wellbore to fall below the bubble-point pressure in the reservoir at any time during the specified period. At the end of the specified period, the production rate is measured for each individual phase of the reservoir fluid.

At the end of the third iteration, each of the gauges are removed from the wellbore. The measured production rates from each of the three iterations, downhole pressure data, and temperature data are gathered to calculate respective apparent skin factors for the measured production rates. As will be discussed in more detail below, each calculated apparent skin factor is plotted on a Cartesian graph against a corresponding squared production rate (i.e., s' vs. $q^2$) to determine individual, distinct skin factor components (e.g., the well skin factor, s, and the completion skin factor associated with the ICD characteristic parameter, $\alpha$), for the apparent skin factor, s', where the intercept of a line, drawn through the plotted points, on the s'-axis ($q^2=0$) defines the well skin factor, s, and the slope of the line defines the characteristic parameter of the ICD, $\alpha$, which can be used to estimate the completion skin factor using Equation 1 discussed below.

In accordance with an embodiment of the invention, each flow/build-up sequence can be carried out over a specified period of time as long as the well skin factor can be assumed not to vary over this specified period of time. In accordance with another embodiment, more than three choke settings may be selected to obtain measured production rates, downhole pressure data, and temperature data to determine the apparent skin factors for different production rates.

Figure 3:
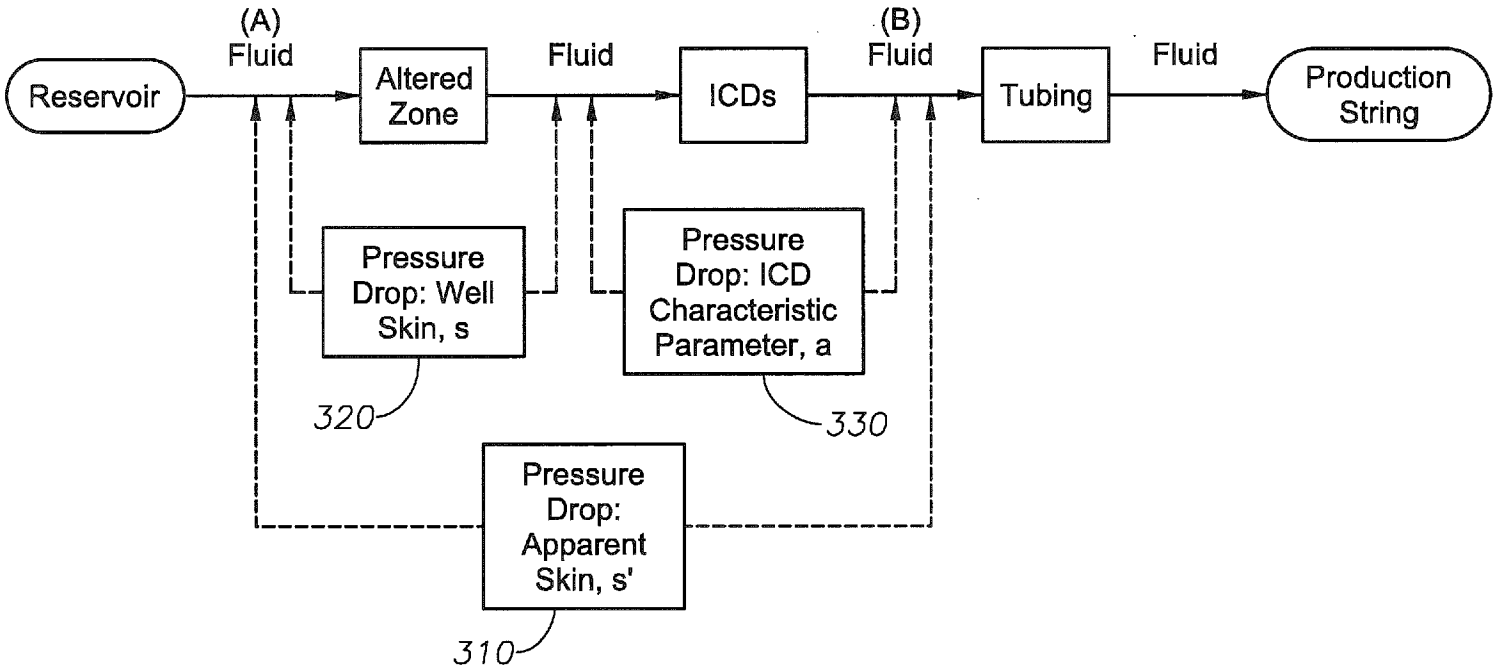
FIG. 3 is a schematic diagram showing a comparison of pressure drop sequencing between a transient testing method, in accordance with an embodiment of the invention, and a conventional transient testing method.

FIG. 3 is a schematic diagram showing a comparison of pressure drop sequencing between a transient testing method, in accordance with an embodiment of the invention, and a conventional transient testing method. As shown in FIG. 3, a conventional transient testing method, for example, a single-rate, transient testing of a well generates an apparent skin factor, s', caused by the effective pressure drop 310, which is the summation of a first pressure drop 320 (e.g., well skin factor, s) and a second pressure drop 330 (e.g., ICD characteristic parameter, $\alpha$). Thus, the apparent skin factor represents the total pressure drop between the inlet point of the wellbore at an altered region (A) (i.e., caused by damaged formation) and a point in the production tubing downstream of the one or more ICDs (B). Because the apparent skin factor determined by conventional transient testing methods includes the additional pressure drop caused by the presence of the one or more ICDs, reservoir and production engineers are unable to accurately determine, based solely on a well skin factor value, whether stimulation of a well would improve the well's productivity. Therefore, conventional transient testing methods are unable to accurately determine which well(s) to stimulate.

Certain embodiments of the invention provide a transient testing method, as illustrated in FIG. 2 and discussed above, which determines apparent skin factors at different production rates, which can be defined in terms of its individual, distinct skin factor components: the well skin factor 320 and a completion skin factor associated with the ICD characteristic parameter 330. Accordingly, the transient testing method, according to certain embodiments of the invention, allows reservoir and production engineers to determine with more certainty, based on the component well skin factor 320, whether stimulation of a well would improve the well's productivity. Furthermore, the transient testing method, in accordance with certain embodiments of the invention, provides ICD design engineers with the component ICD characteristic parameter 330 for improving the design of the ICDs for future well completions. Furthermore, once the ICD characteristic parameter 330 is known, future design and placement of ICDs can be significantly optimized, based on the assumption that the ICD characteristic parameter 330 should not significantly change over a period of time.

Figure 4:
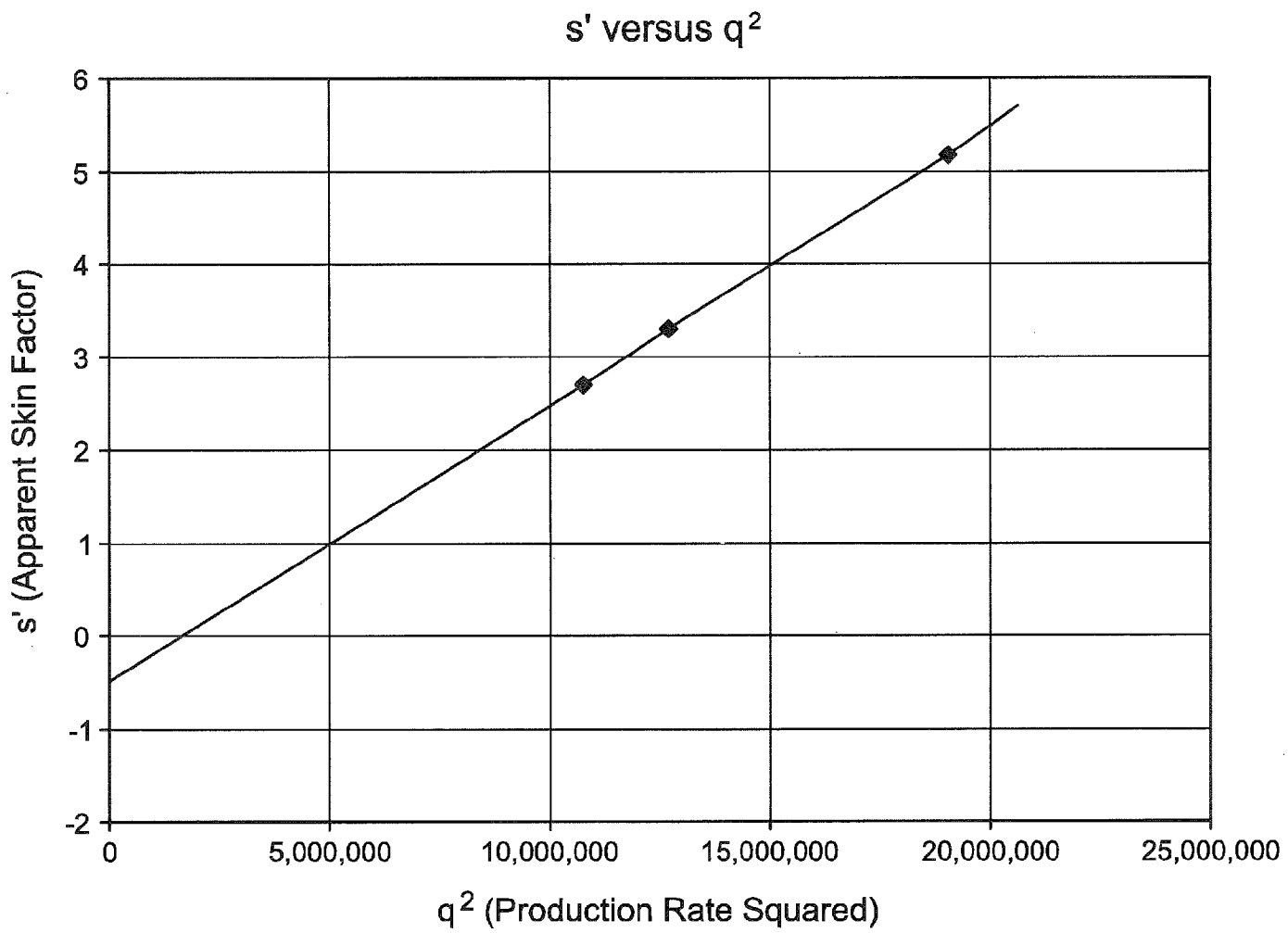
FIG. 4 is a graph showing a relationship between apparent skin factors and production rate-squared values for a transient testing method, in accordance with an embodiment of the invention.

FIG. 4 is a graph showing a relationship between apparent skin factors and production rate-squared values for a transient testing method, in accordance with an embodiment of the invention. According to an embodiment of the invention, multiple (e.g., three or more) transient tests, in accordance with an embodiment of the invention, as shown in FIG. 2, can be conducted for the reservoir fluid flow through the wellbore, as shown in FIG. 1, at various production rates (i.e., at different q-values to generate a spread of data points) to generate an apparent skin factor, s', for each respective production rate (see FIG. 4, where a production rate squared, $q^2$, of approximately 11,000,000 correlates to an apparent skin factor, s', of approximately 2.75, etc.).

According to certain embodiments of the invention, the apparent skin factor, s', for a given production rate, q, can be represented by the following equation:

$$s'(q)=s+aq^2 \tag{1}$$

where s=the well skin factor and $\alpha$=a characteristic parameter of an ICD under field conditions (two unknown parameters). The second term of Equation 1 (e.g., $aq^2$) defines the completion skin factor due to the pressure drop caused by one or more ICDs in the wellbore. According to an embodiment of the invention, the well skin factor is not expected to change in value, while the characteristic parameter of the one or more ICDs is a function of the production rate in the wellbore.

As shown in FIG. 4, each calculated apparent skin factor can be plotted against a respective squared production rate on a Cartesian graph to show a relationship, as defined by Equation 1, where the calculated apparent skin factors should fall on a straight line. As briefly noted above, the intercept of the line on the s'-axis at $q^2=0$ defines the well skin factor, s. The well skin factor may have a negative, positive, or zero value based on the pressure drop generated by the formation damage in the wellbore. The slope of the line defines the characteristic parameter of the one or more ICDs, $\alpha$, which can be used to estimate the completion skin factor using Equation 1. This characteristic parameter indicates how restrictive the ICDs are to the reservoir fluid flow while in operation.

Accordingly, the transient testing method according to various embodiments of the invention has non-obvious advantages over conventional transient testing methods in that an apparent skin factor can be determined in terms of its individual, distinct skin factor components of well skin factor and completion skin factor. Using these component skin factors, reservoir and production engineers can determine with more certainty, based on the component well skin factor, whether stimulation of a well would improve the well's productivity, and ICD design engineers can improve, based on the component ICD characteristic parameter, the design of ICDs for future well completions.

Embodiments of the present invention may suitably comprise, consist or consist essentially of the elements disclosed and may be practiced in the absence of an element not disclosed. For example, it can be recognized by those skilled in the art that certain steps can be combined into a single step.

Unless defined otherwise, all technical and scientific terms used have the same meaning as commonly understood by one of ordinary skill in the art to which this invention belongs.

The singular forms "a," "an," and "the" include plural referents, unless the context clearly dictates otherwise.

As used herein and in the appended claims, the words "comprise," "has," and "include" and all grammatical variations thereof are each intended to have an open, non-limiting meaning that does not exclude additional elements or steps.

Although the present invention has been described in detail, it should be understood that various changes, substitutions, and alterations can be made hereupon without departing from the principle and scope of the invention. Accordingly, the scope of the present invention should be determined by the following claims and their appropriate legal equivalents.

What is claimed is:

1. A method for transient testing of a well, the method comprising:

opening the well to a first predefined choke setting to allow the reservoir fluid to flow through the well for a first predefined period of time;

measuring a production rate of the reservoir fluid through the well, when the first predefined period of time expires;

performing a shut-in of the well for a first predefined build-up period;

when the first predefined build-up period expires, repeating the opening the well, the measuring of the production rate of the reservoir fluid through the well, and the performing the shut-in of the well for at least two additional choke settings, wherein each of the additional choke settings is consecutively lower than a preceding choke setting;

determining an apparent skin factor for each measured production rate, wherein the apparent skin factor is a function of the measured production rate, and wherein, when each of the determined apparent skin factors is plotted against a respective squared-measured production rate value, the plotted values form a linear relationship; and determining a well skin factor and a completion skin factor based on the determined apparent skin factor, wherein the well skin factor is defined by an intercept of the linear relationship when the squared-measured production rate is zero and the completion skin factor is defined by a product of the slope of the linear relationship and the squared-measured production rate.

2. The method of claim 1, wherein the opening the well comprises controlling the reservoir fluid flow through the well for the first predefined period of 72 hours, and controlling the reservoir fluid flow through the well for a predefined period of at least 24 hours for each of the at least two additional choke settings.

3. The method of claim 1, wherein the opening the well further comprises controlling the reservoir fluid flow through the well without allowing the pressure in a wellbore of the well to fall below a bubble-point pressure in a reservoir of the well at any time during the first predefined period of time.

4. The method of claim 1, wherein the measuring comprises determining the production rate for each individual phase of the reservoir fluid.

5. The method of claim 1, wherein the performing comprises controlling the shut-in of the well for the first predefined build-up period and the shut-in of the well for each of the at least two additional choke settings to establish an infinite-acting radial flow regime.

6. The method of claim 1, wherein the repeating comprises repeating the flowing, the measuring, and the performing for the at least two additional choke settings, wherein each of the additional choke settings differs from the preceding choke setting by at least 500 stock tank barrels per day.

7. The method of claim 1, wherein the determining the apparent skin factor for each measured production rate comprises calculating the apparent skin factor as a function of the measured production rate based on the following equation:

$$s'(q)=s+aq^2.$$

* * * * *